US010746174B2

(12) United States Patent
Daussin et al.

(10) Patent No.: US 10,746,174 B2
(45) Date of Patent: Aug. 18, 2020

(54) SCROLL COMPRESSOR WITH AN ORBITAL DISC LUBRICATION SYSTEM

(71) Applicant: DANFOSS COMMERCIAL COMPRESSORS S.A., Reyrieux, Trevoux (FR)

(72) Inventors: Arnaud Daussin, Saint Germain au Mont d'or (FR); Sebastien Denis, Nordborg (DK); David Genevois, Cailloux sur Fontaine (FR); Remi Bou Dargham, Villeurbanne (FR)

(73) Assignee: Danfoss Commercial Compressors, Trevoux (FR)

( * ) Notice: Subject to any disclaimer, the term of this patent is extended or adjusted under 35 U.S.C. 154(b) by 308 days.

(21) Appl. No.: 15/852,200

(22) Filed: Dec. 22, 2017

(65) Prior Publication Data

US 2018/0216616 A1 Aug. 2, 2018

(30) Foreign Application Priority Data

Jan. 27, 2017 (FR) ..... 17 50672

(51) Int. Cl.
*F04C 18/02* (2006.01)
*F04C 29/02* (2006.01)
(Continued)

(52) U.S. Cl.
CPC ..... *F04C 18/0215* (2013.01); *F01C 17/066* (2013.01); *F04C 29/023* (2013.01);
(Continued)

(58) Field of Classification Search
CPC .. F04C 2240/50; F04C 29/023; F04C 29/025; F04C 29/028; F04C 18/0215
See application file for complete search history.

(56) References Cited

U.S. PATENT DOCUMENTS 5,154,592 A 10/1992 Ohtani et al.
5,330,335 A * 7/1994 Teracuhi ..... F04C 29/025 418/55.6
(Continued)

FOREIGN PATENT DOCUMENTS

CN 102650288 A 8/2012
CN 203098282 U 7/2013
(Continued)

OTHER PUBLICATIONS

Machine translation of JP 58-030402, inventor: Masahisa, Title: Scroll Compressor. (Year: 1983).*
(Continued)

*Primary Examiner* — Mary Davis
(74) *Attorney, Agent, or Firm* — McCormick, Paulding & Huber PLLC

(57) ABSTRACT

The scroll compressor (1) includes a fixed scroll (7); an orbiting scroll (8); a drive shaft (16); a support arrangement (5) including a thrust bearing surface (9) on which is slidably mounted the orbiting scroll (8); a rotation preventing device configured to prevent rotation of the orbiting scroll (8) with respect to the fixed scroll (7), the rotation preventing device including orbital discs (28) respectively arranged in circular receiving holes (29) provided on the support arrangement (5), each orbital disc (28) being provided with an outer circumferential bearing surface (31) cooperating with an inner circumferential bearing surface (32) of the respective circular receiving hole (29); and a lubrication system configured to lubricate the inner and outer circumferential bearing surfaces (32, 31) with oil supplied from an oil sump (50), the lubrication system including lubrication passages (41) formed within the support arrangement (5), each lubrication passage (41) including an oil outlet aperture (41.2) emerging in the inner circumferential bearing surface (32) of a respective circular receiving hole (29) and at a predeter-
(Continued)

mined position where low load is applied on the respective orbital disc during rotation of the drive shaft.

20 Claims, 5 Drawing Sheets

(51) Int. Cl.
*F01C 17/06* (2006.01)
*F04C 23/00* (2006.01)

(52) U.S. Cl.
CPC ..... *F04C 29/028* (2013.01); *F04C 23/008* (2013.01); *F04C 2240/50* (2013.01); *F04C 2240/807* (2013.01)

(56) References Cited

U.S. PATENT DOCUMENTS

| | | | |
|---|---|---|---|
| 6,309,196 | B1 | 10/2001 | Jones et al. |
| 2004/0101428 | A1 | 5/2004 | Shibamoto et al. |
| 2005/0135957 | A1 | 6/2005 | Park |
| 2014/0170007 | A1 | 6/2014 | Stone et al. |
| 2016/0341200 | A1 | 11/2016 | Sato et al. |
| 2017/0002816 | A1* | 1/2017 | Uekawa ..... F04C 29/023 |

FOREIGN PATENT DOCUMENTS

| | | | |
|---|---|---|---|
| CN | 203463283 | U | 3/2014 |
| CN | 104685213 | A | 6/2015 |
| JP | S5830402 | A | 2/1983 |
| JP | 2005240700 | A | 9/2005 |
| JP | 4427354 | B2 | 12/2009 |
| JP | 2014173525 | A | 9/2014 |
| WO | 2014168084 | A1 | 10/2014 |
| WO | 2015064612 | A1 | 5/2015 |

OTHER PUBLICATIONS

Machine translation of JP 2005-240700, inventor: Masaaki, Title: Scroll Compressor. (Year: 2005).*

Search Report for French Serial No. FR 1750672 dated Sep. 6, 2017.

* cited by examiner

SCROLL COMPRESSOR WITH AN ORBITAL DISC LUBRICATION SYSTEM

CROSS-REFERENCE TO RELATED APPLICATION

This application claims foreign priority benefits under U.S.C. § 119 to French Patent Application No. 1750672 filed on Jan. 27, 2017, the content of which is hereby incorporated by reference in its entirety.

TECHNICAL FIELD

The present invention relates to a scroll compressor, and in particular to a scroll refrigeration compressor.

BACKGROUND

JP4427354 discloses a scroll compressor including:

- a fixed scroll comprising a fixed base plate and a fixed spiral wrap,
- an orbiting scroll including an orbiting base plate and an orbiting spiral wrap, the fixed spiral wrap and the orbiting spiral wrap forming a plurality of compression chambers,
- a drive shaft including a driving portion configured to drive the orbiting scroll in an orbital movement, the drive shaft being rotatable around a rotation axis,
- a support frame including a thrust bearing surface on which is slidably mounted the orbiting scroll,
- a rotation preventing device configured to prevent rotation of the orbiting scroll with respect to the fixed scroll and the support arrangement, the rotation preventing device including:
  - a plurality of orbital discs respectively arranged in circular receiving holes provided on the support arrangement, each orbital disc being provided with an eccentric hole and with an outer circumferential bearing surface configured to cooperate with an inner circumferential bearing surface provided on the respective circular receiving hole, and
  - a plurality of pins each including a first end portion secured to the orbiting base plate and a second end portion rotatably mounted in the eccentric hole of a respective orbital disc,
- an oil sump, and
- a lubrication system configured to lubricate at least partially the inner and outer circumferential bearing surfaces with oil supplied from the oil sump.

Particularly, the lubrication system includes a plurality of lubrication grooves formed in the thrust bearing surface, each lubrication grooves including a first end emerging in an inner surface of the support frame and a second end emerging in the inner circumferential bearing surface of a respective circular receiving hole and at a position where high load occurs during rotation of the drive shaft around its rotation axis.

Such a provision of the lubrication grooves in the thrust bearing surface decreases the surface area of the thrust bearing surface, which may harm the reliability of the scroll compressor.

Further such a location of the second end of each lubrication groove does not ensure a proper lubrication of the outer circumferential bearing surfaces of the orbital discs, especially for scroll compressors having large capacity, since the high loads applied on the orbital discs during rotation of the drive shaft avoids or at least limits the oil supply between the outer circumferential bearing surfaces and the inner circumferential bearing surfaces of the rotation preventing device.

Consequently, the configuration of the lubrication system of the scroll compressor previously disclosed does not ensure, especially for high capacity scroll compressors, an optimized oil supply to the rotation preventing device, which may harm the reliability and lifetime of the scroll compressor.

SUMMARY

It is an object of the present invention to provide an improved scroll compressor which can overcome the drawbacks encountered in conventional scroll compressors.

Another object of the present invention is to provide a scroll compressor which has an improved reliability and lifetime compared to the conventional scroll compressors.

According to the invention such a scroll compressor includes:

- a fixed scroll comprising a fixed base plate and a fixed spiral wrap,
- an orbiting scroll including an orbiting base plate and an orbiting spiral wrap, the fixed spiral wrap and the orbiting spiral wrap forming a plurality of compression chambers,
- a drive shaft including a driving portion configured to drive the orbiting scroll in an orbital movement, the drive shaft being rotatable around a rotation axis,
- a support arrangement including a thrust bearing surface on which is slidably mounted the orbiting scroll,
- a rotation preventing device configured to prevent rotation of the orbiting scroll with respect to the fixed scroll and to the support arrangement, the rotation preventing device including:
  - a plurality of orbital discs respectively arranged in circular receiving holes provided on the support arrangement, each orbital disc being provided with an eccentric hole and with an outer circumferential bearing surface configured to cooperate with an inner circumferential bearing surface provided on the respective circular receiving hole, and
  - a plurality of pins each including a first end portion secured, and particularly unrotatably secured, to the orbiting base plate and a second end portion rotatably mounted in and cooperating with the eccentric hole of a respective orbital disc,
- an oil sump, and
- a lubrication system configured to lubricate at least partially the inner and outer circumferential bearing surfaces with oil supplied from the oil sump, the lubrication system including a plurality of lubrication passages formed within the support arrangement, each lubrication passage including an oil outlet aperture emerging in the inner circumferential bearing surface of a respective circular receiving hole and at a predetermined position where low load occurs during rotation of the drive shaft around its rotation axis.

Such a configuration of the lubrication system, and particularly such a location of the oil outlet aperture of each lubrication passage, ensures a proper lubrication of the outer circumferential bearing surfaces of the orbital discs, and therefore imparts to the scroll compressor an improved reliability and lifetime.

Further, since the lubrication passage are formed within the support arrangement, and not in the thrust bearing surface, the surface area of the latter is not decreased, which also improves the reliability of the scroll compressor.

The scroll compressor may also include one or more of the following features, taken alone or in combination.

According to an embodiment of the invention, an orthogonal projection of the predetermined position of the oil outlet aperture of each lubrication passage on a projection plane parallel to the thrust bearing surface is located on a circular arc having an angle between 0 and 20°, and for example between 0 and 10°, having a center centered on a center of the respective circular receiving hole, and being defined such that a respective plane containing the rotation axis of the drive shaft and the center of the respective circular receiving hole forms a bisecting plane of the angle of said circular arc, i.e. such that a respective plane containing the rotation axis of the drive shaft and the center of the respective circular receiving hole also contains an angle bisector of the angle of said circular arc, and advantageously such that said circular arc is located between the rotation axis of the drive shaft and the center of the respective circular receiving hole.

According to an embodiment of the invention, the predetermined position of the oil outlet aperture of each lubrication passage is substantially located in a respective plane containing the rotation axis of the drive shaft and a center of the respective circular receiving hole, and is particularly positioned between the rotation axis of the drive shaft and the center of the respective circular receiving hole.

According to an embodiment of the invention, each lubrication passage extends radially with respect to the rotation axis of the drive shaft.

According to an embodiment of the invention, each lubrication passage extends below the thrust bearing surface.

According to an embodiment of the invention, the lubrication system further includes a circumferential groove provided on an inner surface of the support arrangement, the circumferential groove being configured to supply the lubrication passages with oil. The provision of the circumferential groove ensures a better feeding and filling of the lubrication passages, and thus improves the lubricating of the rotation preventing device.

According to an embodiment of the invention, each lubrication passage includes an oil inlet aperture emerging in the inner surface of the support arrangement, and for example in the circumferential groove.

According to an embodiment of the invention, the inner surface of the support arrangement defines a receiving chamber in which the driving portion of the drive shaft is movably disposed.

According to an embodiment of the invention, the lubrication system further includes an oil supplying channel fluidly connected to the oil sump and extending over at least a part of the length of the drive shaft, the lubrication passages being fluidly connected to the oil supplying channel.

According to an embodiment of the invention, the oil supplying channel emerges in an end face of the drive shaft oriented towards the orbiting scroll.

According to an embodiment of the invention, the orbiting scroll further includes a hub portion in which the driving portion of the drive shaft is at least partially mounted, the scroll compressor further including a counterweight connected to the driving portion and configured to at least partially balance the mass of the orbiting scroll.

According to an embodiment of the invention, the counterweight is movably disposed in the receiving chamber.

According to an embodiment of the invention, the lubrication system further includes at least one oil supplying passage at least partially defined by the counterweight, the at least one oil supplying passage being configured to supply the thrust bearing surface and the lubrication passages with oil.

According to an embodiment of the invention, the at least one oil supplying passage is configured to supply the circumferential groove with oil.

According to an embodiment of the invention, the counterweight includes a counterweight inner surface and a counterweight end surface respectively facing the hub portion and the orbiting base plate, the counterweight inner surface and the counterweight end surface at least partially defining the at least one oil supplying passage.

According to an embodiment of the invention, the counterweight includes at least one oil supplying groove or bore provided on the counterweight inner surface and the counterweight end surface and defining the at least one oil supplying passage.

According to an embodiment of the invention, the counterweight comprises an oil supply passage with an inlet formed at the counterweight inner surface and an outlet facing the circumferential groove. For example the counterweight includes at least one oil supplying groove or bore with an inlet provided on the counterweight inner surface and an outlet facing the circumferential groove.

According to an embodiment of the invention, the counterweight inner surface and the counterweight end surface are respectively substantially complementary to respective contours of the hub portion and the orbiting base plate.

According to an embodiment of the invention, the at least one oil supplying passage is fluidly connected to the oil supplying channel.

According to an embodiment of the invention, the lubrication system includes an oil feeding passage provided on, and for example formed within, the driving portion of the drive shaft and fluidly connected to the oil supplying channel, the oil feeding passage being configured to supply the at least one oil supplying passage with oil.

According to an embodiment of the invention, the oil feeding passage includes a first end emerging in the end face of the drive shaft oriented towards the orbiting scroll and a second end emerging in an outer wall of the driving portion of the drive shaft facing the counterweight.

According to an embodiment of the invention, the support arrangement includes a support frame and a thrust bearing plate secured to the support frame, the thrust bearing plate including the thrust bearing surface and the circular receiving holes, the lubrication passages being formed within the thrust bearing plate.

According to an embodiment of the invention, each circular receiving hole emerges in the thrust bearing surface.

According to an embodiment of the invention, the lubrication system further includes a plurality of oil return passages provided on, and for example formed within, the support arrangement, each oil return passage includes an oil inlet port emerging in a respective one of the circular receiving holes and an oil outlet port fluidly connected to the oil sump and configured to return a part of the oil contained in the respective one of the circular receiving holes towards the oil sump. The provision of the oil return passages ensures an oil circulation after lubricating the rotation preventing device.

According to an embodiment of the invention, the oil return passages are formed in the support frame.

According to an embodiment of the invention, the oil outlet port of each oil return passage emerges in the inner surface of the support arrangement.

According to an embodiment of the invention, the oil inlet port of each oil return passage is provided on the thrust bearing plate, and each oil return passage includes an oil return channel provided on the support frame and fluidly connected to the respective oil inlet port.

According to an embodiment of the invention, each oil return passage further includes a vertical hole provided on the support frame and configured to fluidly connect the respective oil inlet port with the respective oil return channel.

According to an embodiment of the invention, the support arrangement further includes a main bearing configured to guide in rotation a guided portion of the drive shaft, the lubrication system being configured to lubricate at least partially the main bearing with oil supplied from the oil sump.

According to an embodiment of the invention, the lubrication system further includes a lubrication hole provided on the drive shaft and fluidly connected to the oil supplying channel, the lubrication hole emerging in an outer wall of the guided portion of the drive shaft and facing the main bearing.

These and other advantages will become apparent upon reading the following description in view of the drawings attached hereto representing, as non-limiting example, an embodiment of a scroll compressor according to the invention.

BRIEF DESCRIPTION OF THE DRAWINGS

The following detailed description of one embodiment of the invention is better understood when read in conjunction with the appended drawings being understood, however, that the invention is not limited to the specific embodiment disclosed.

DETAILED DESCRIPTION

In the description which follows, the same elements are designated with the same references in the different embodiments.

Figure 1:
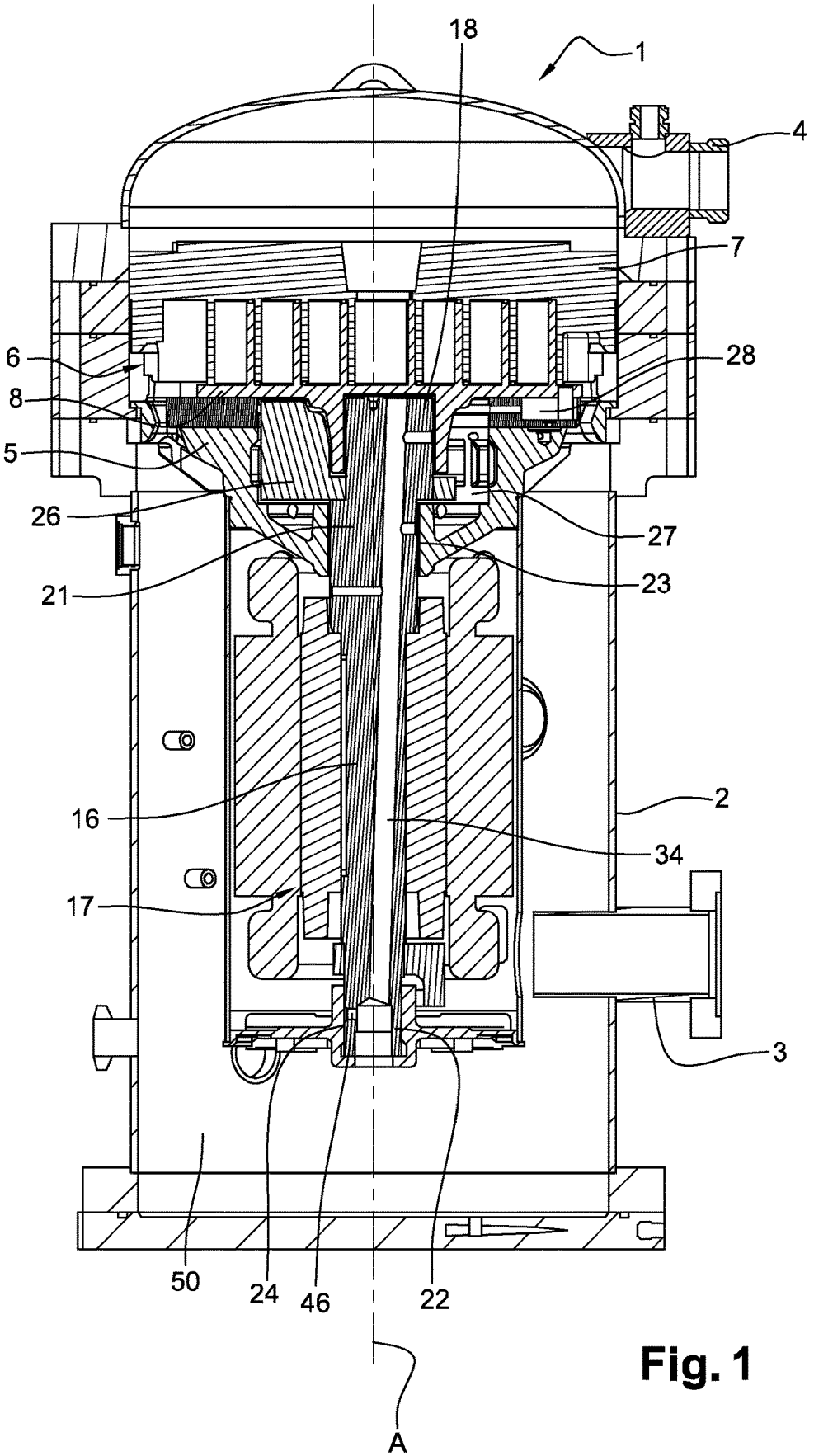
FIG. 1 is a longitudinal section view of a scroll compressor according to the invention.
Figure 2:
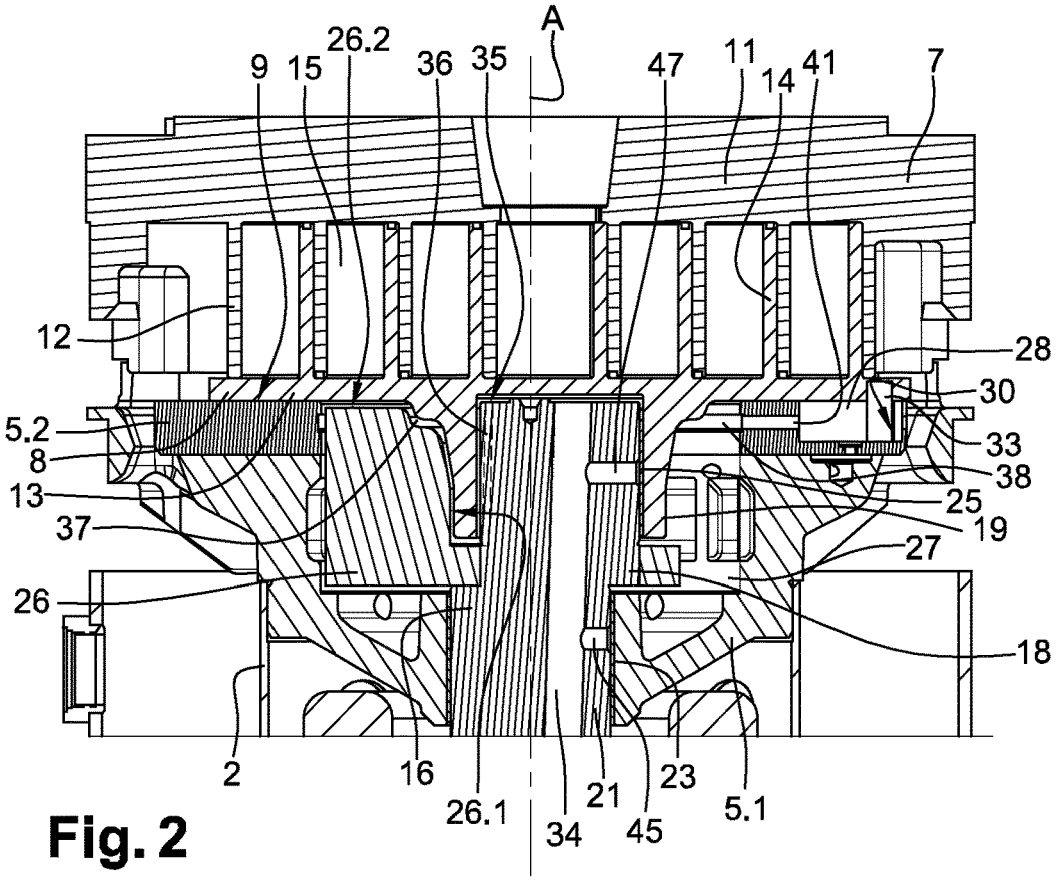
FIG. 2 is a partial longitudinal section view of the scroll compressor according to FIG. 1.
Figure 3:
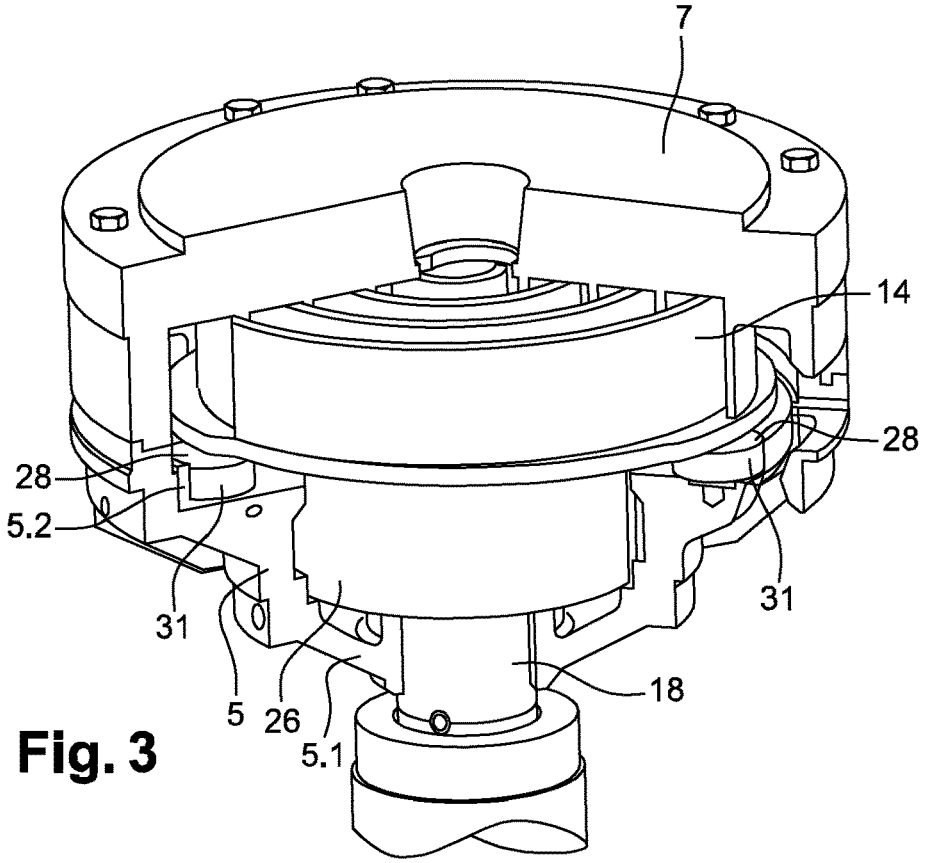
FIG. 3 is a perspective view, partially sectioned, of the scroll compressor according to FIG. 1.

FIG. 1 describes a scroll compressor 1 according to an embodiment of the invention occupying a vertical position.

The scroll compressor 1 includes a hermetic casing 2 provided with a suction inlet 3 configured to supply the scroll compressor 1 with refrigerant to be compressed, and with a discharge outlet 4 configured to discharge compressed refrigerant.

The scroll compressor 1 further includes a support arrangement 5, also named crankcase, fixed to the hermetic casing 2, and a compression unit 6 disposed inside the hermetic casing 2 and supported by the support arrangement 5. The compression unit 6 is configured to compress the refrigerant supplied by the suction inlet 3. The compression unit 6 includes a fixed scroll 7, which is fixed in relation to the hermetic casing 2, and an orbiting scroll 8 supported by and in slidable contact with a thrust bearing surface 9 provided on the support arrangement 5.

The fixed scroll 7 includes a fixed base plate 11 having a lower face oriented towards the orbiting scroll 8, and an upper face opposite to the lower face of the fixed base plate 11. The fixed scroll 7 also includes a fixed spiral wrap 12 projecting from the lower face of the fixed base plate 11 towards the orbiting scroll 8.

The orbiting scroll 8 includes an orbiting base plate 13 having an upper face oriented towards the fixed scroll 7, and a lower face opposite to the upper face of the orbiting base plate 13 and slidably mounted on the thrust bearing surface 9. The orbiting scroll 8 also includes an orbiting spiral wrap 14 projecting from the upper face of the orbiting base plate 13 towards the fixed scroll 7. The orbiting spiral wrap 14 of the orbiting scroll 8 meshes with the fixed spiral wrap 12 of the fixed scroll 7 to form a plurality of compression chambers 15 between them. Each of the compression chambers 15 has a variable volume which decreases from the outside towards the inside, when the orbiting scroll 8 is driven to orbit relative to the fixed scroll 7.

Furthermore the scroll compressor 1 includes a drive shaft 16 configured to drive the orbiting scroll 8 in an orbital movement, and an electric driving motor 17, which may be a variable-speed electric driving motor, coupled to the drive shaft 16 and configured to drive in rotation the drive shaft 16 about a rotation axis A.

The drive shaft 16 includes, at its upper end, a driving portion 18 which is offset from the longitudinal axis of the drive shaft 16, and which is partially mounted in a hub portion 19 provided on the orbiting scroll 8. The driving portion 18 is configured to cooperate with the hub portion 19 so as to drive the orbiting scroll 8 in orbital movements relative to the fixed scroll 7 when the electric driving motor 17 is operated.

The drive shaft 16 also includes an upper guided portion 21 adjacent to the driving portion 18 and a lower guided portion 22 opposite to the first guided portion 21, and the scroll compressor 1 further includes an upper main bearing 23 provided on the support arrangement 5 and configured to guide in rotation the upper guided portion 21 of the drive shaft 16, and a lower main bearing 24 configured to guide in rotation the lower guided portion 22 of the drive shaft 16. The scroll compressor 1 also includes an orbiting scroll hub bearing 25 provided on the orbiting scroll 8 and arranged for cooperating with the driving portion 18 of the drive shaft 16.

Furthermore, the scroll compressor includes a counterweight 26 secured to the driving portion 18 and configured to at least partially balance the mass of the orbiting scroll 8. Particularly, the support arrangement 5 defines a receiving chamber 27 located above the upper main bearing 23 and in which the hub portion 19, the driving portion 18 and the counterweight 26 are movably disposed.

The scroll compressor 1 also includes a rotation preventing device configured to prevent rotation of the orbiting scroll 8 with respect to the fixed scroll 7 and the support arrangement 5. Particularly, the rotation preventing device includes:

- a plurality of orbital discs 28 respectively arranged in circular receiving holes 29 formed in the support arrangement 5 and emerging in the thrust bearing surface 9, each orbital disc 28 being provided with an eccentric hole 30 and with an outer circumferential bearing surface 31 configured to cooperate with an inner circumferential bearing surface 32 provided on the respective circular receiving hole 29, and
- a plurality of pins 33 each including a first end portion unrotatably secured to the orbiting base plate 13 and a second end portion rotatably mounted in and cooperating with the eccentric hole 30 of the respective orbital disc 28.

According to the embodiment shown on the figures, the rotation preventing device includes three orbital discs 28 and three pins 33, the orbital discs 28 being angularly offset, and particularly regularly angularly offset, with respect to the rotation axis A of the drive shaft 16.

The scroll compressor 1 further comprises a lubrication system configured to lubricate at least partially the inner and outer circumferential bearing surfaces 31, 32, the sliding surface between orbital discs 28 and the bottom of respective receiving holes 29, as well as the sliding surfaces between eccentric holes 30 and pins 33 with oil supplied from an oil sump 50 defined by the hermetic casing 2.

The lubrication system includes an oil supplying channel 34 formed within the drive shaft 16 and extending over the whole length of the drive shaft 16. The oil supplying channel 34 is configured to be supplied with oil from the oil sump 50. According to the embodiment shown on the figures, the oil supplying channel 34 emerges in an end face 35 of the drive shaft 16 oriented towards the orbiting scroll 8.

The lubrication system further includes an oil feeding passage 36 provided on the driving portion 18 of the drive shaft 16 and fluidly connected to the oil supplying channel 34. According to the embodiment shown on the figures, the oil feeding passage 36 includes a first end emerging in the end face 35 of the drive shaft 16 and a second end emerging in an outer wall of the driving portion 18 facing the counterweight 26 in the area of the lower end of hub portion 19.

The lubrication system also includes an oil supplying passage 37 defined by the counterweight 26 and fluidly connected to the oil feeding passage 36. According to the embodiment shown on the figures, the counterweight 26 includes a counterweight inner surface 26.1 and a counterweight end surface 26.2 respectively facing the hub portion 19 and the orbiting base plate 13, and the counterweight inner surface 26.1 and the counterweight end surface 26.2 define the oil supplying passage 37. For example, the counterweight 26 may include an oil supplying groove provided on the counterweight inner surface 26.1 and on the counterweight end surface 26.2 and defining the oil supplying passage. Advantageously, the counterweight inner surface 26.1 and the counterweight end surface 26.2 are respectively substantially complementary to respective contours of the hub portion 19 and the orbiting base plate 13.

Figure 4:
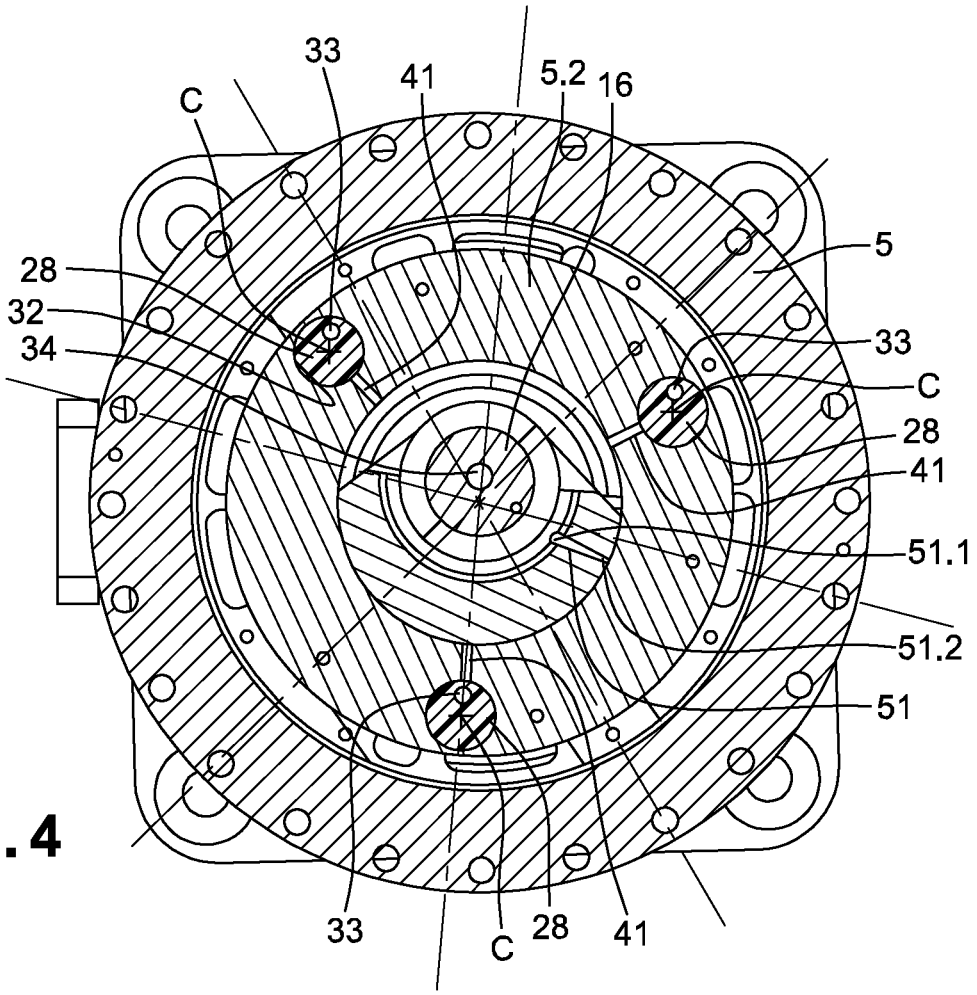
FIG. 4 is a transversal section view of the scroll compressor according to FIG. 1.
Figure 5:
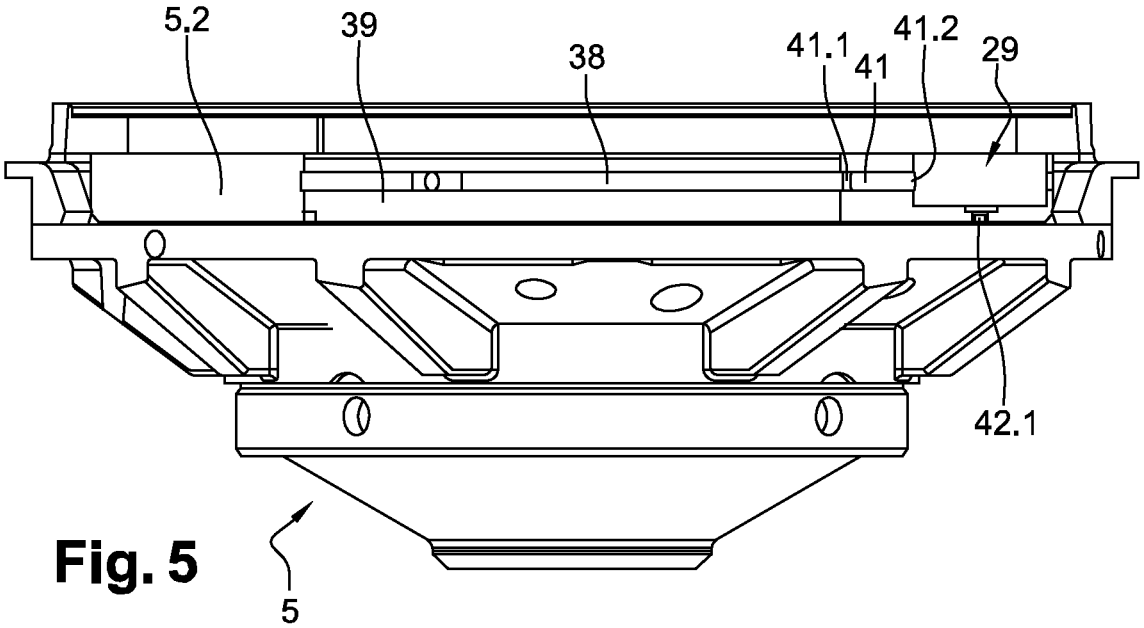
FIG. 5 is a longitudinal section view of a support arrangement of the scroll compressor according to FIG. 1.
Figure 6:
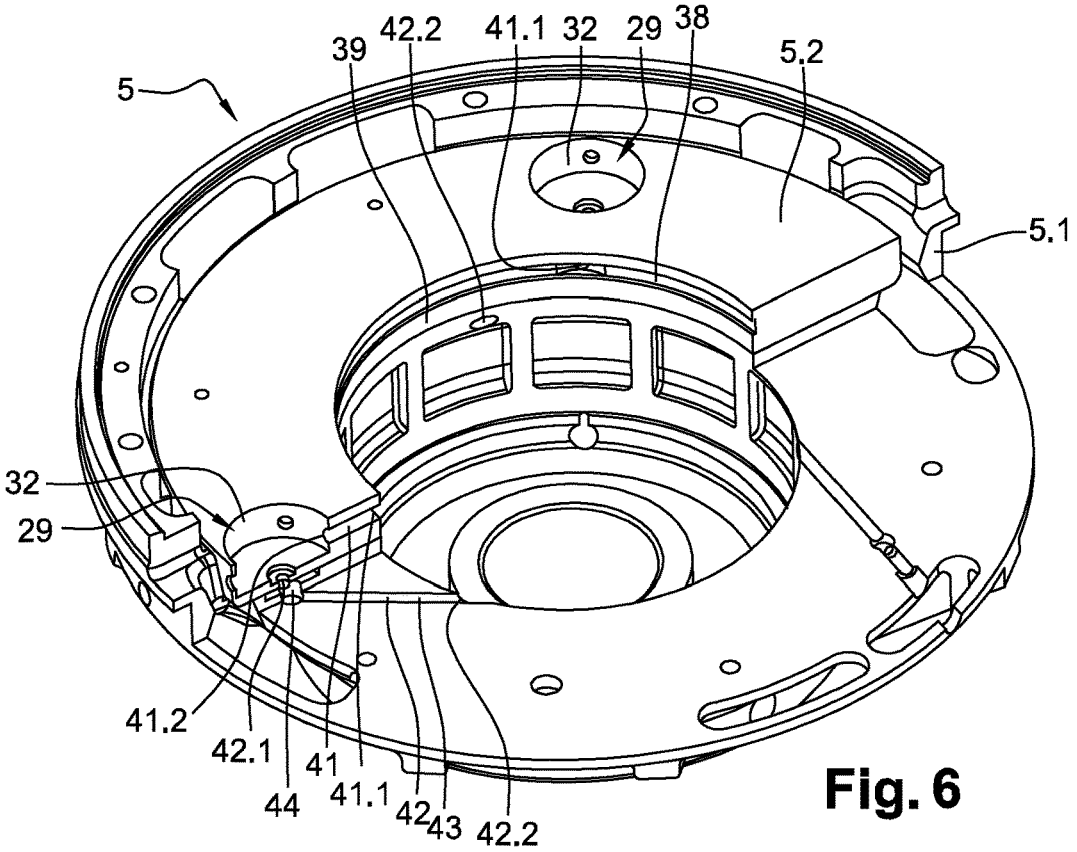
FIG. 6 is a perspective view, partially sectioned, of the support arrangement according to FIG. 4.

Furthermore, the lubrication system includes a circumferential groove 38 provided on an inner surface 39 of the support arrangement 5, and a plurality of lubrication passages 41 formed within the support arrangement 5 and fluidly connected to the circumferential groove 38. The counterweight 26 may further include an oil supply passage 51 (see FIG. 4) with an inlet 51.1 formed at the counterweight inner surface 26.1 and an outlet 51.2 facing the circumferential groove 38.

According to the embodiment shown on the figures, each lubrication passage 41 extends radially with respect to the rotation axis A of the drive shaft 16, and extends below the thrust bearing surface 9.

Particularly, each lubrication passage 41 includes an oil inlet aperture 41.1 emerging in the circumferential groove 38, and an oil outlet aperture 41.2 emerging in the inner circumferential bearing surface 32 of a respective circular receiving hole 29 and at a predetermined position substantially located in a respective plane containing the rotation axis A of the drive shaft and a center C of the respective circular receiving hole 29 and positioned between the rotation axis A of the drive shaft 16 and the center of the respective circular receiving hole.

The lubrication system further includes a plurality of oil return passages 42 formed within the support arrangement 5. Each oil return passage 42 includes an oil inlet port 42.1 emerging in a respective one of the circular receiving holes 29, and for example in the bottom surface of the respective circular receiving hole 29, and an oil outlet port 42.2 fluidly connected to the oil sump 50 and configured to return a part of the oil contained in the respective one of the circular receiving holes 29 towards the oil sump 50. According to the embodiment shown on the figures, the oil outlet port 42.2 of each oil return passage 42 emerges in the inner surface 39 of the support arrangement 5, and thus in the receiving chamber 27. Advantageously, the support arrangement 5 includes oil return holes emerging in the receiving chamber 27 and configured to return a part of the oil, ejected from the oil return passage 42 into the receiving chamber 27, towards the oil sump 50.

According to the embodiment shown on the figures, the support arrangement 5 includes a support frame 5.1 and a thrust bearing plate 5.2 secured to the support frame 5.1. Advantageously, the thrust bearing plate 5.2 includes the thrust bearing surface 9, and the circular receiving holes 29 and the lubrication passages 41 are formed within the thrust bearing plate 5.2. Further, according to said embodiment, the oil inlet port 42.1 of each oil return passage 42 is provided on the thrust bearing plate 5.2, and each oil return passage 42 includes an oil return channel 43 provided on the support frame 5.1 and fluidly connected to the respective oil inlet port 42.1. Each oil return passage 42 may further include a vertical hole 44 provided on the support frame 5.1 and configured to fluidly connect the respective oil inlet port 42.1 with the respective oil return channel 43.

Moreover, according to the embodiment shown on the figures, the lubrication system is also configured to lubricate at least partially the upper and lower main bearings 23, 24 and the orbiting scroll hub bearing 25 with oil supplied from the oil sump 50. Therefore, the lubrication system further includes:

- a first lubrication hole 45 provided on the drive shaft 16 and fluidly connected to the oil supplying channel 34, the first lubrication hole 45 emerging in an outer wall of the upper guided portion 21 of the drive shaft 16 and facing the upper main bearing 23,
- a second lubrication hole 46 provided on the drive shaft 16 and fluidly connected to the oil supplying channel 34, the second lubrication hole 46 emerging in an outer wall of the lower guided portion 22 of the drive shaft 16 and facing the lower main bearing 24, and a third lubrication hole 47 provided on the drive shaft 16 and fluidly connected to the oil supplying channel 34, the third lubrication hole 47 emerging in an outer wall of the driving portion 18 of the drive shaft 16 and facing the orbiting scroll hub bearing 25.

When the electric driving motor 17 is operated and the drive shaft 16 rotates about its rotation axis A, oil from the oil sump 50 climbs into the oil supplying channel 34 of the drive shaft 16 due to centrifugal effect, and reaches the end face 35 of the drive shaft 16 after lubricating the lower main bearing 24, the upper main bearing 23, and the orbiting scroll hub bearing 25. At least a part of the oil having reached the end face 35 of the drive shaft 16 is evacuated towards the oil supplying passage 37 via the oil feeding passage 36 provided on the driving portion 18. Then, due to centrifugal effect, oil flows in the oil supplying passage 37 and is directed towards the thrust bearing surface 9 and the lubrication passages 41 in order to lubricate at least partially the inner and outer circumferential bearing surfaces 31, 32 and the thrust bearing surface 9. Further to the oil originating from oil feeding passage 36, also oil leaving the lower end of orbiting scroll hub bearing 25 will enter the oil supplying passage 37 due to centrifugal effect. After lubricating the inner and outer circumferential bearing surfaces 31, 32 and the thrust bearing surface 9, oil is returned towards the oil sump 50 via the oil return passages 42 and the oil return holes.

Figure 7:
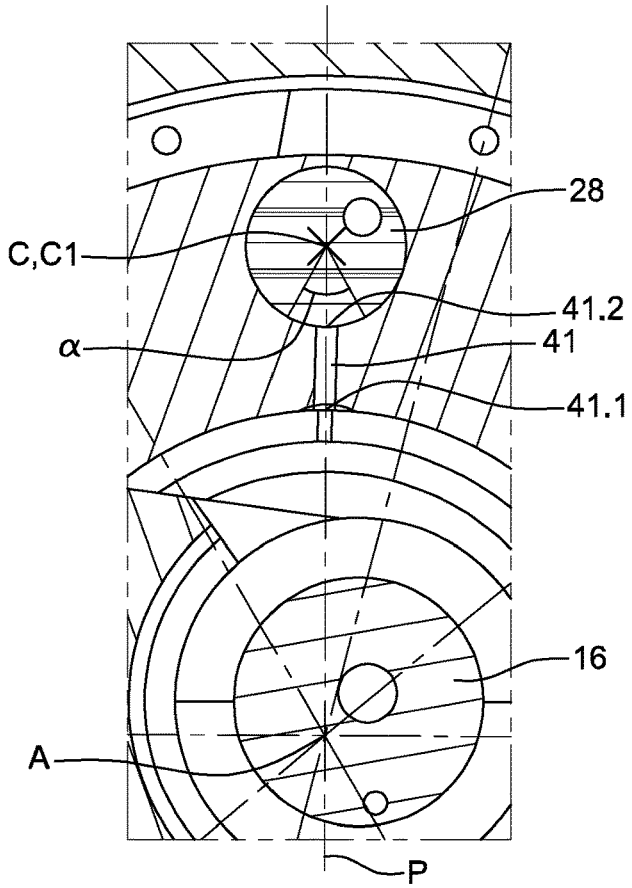
FIG. 7 is an enlarged view of details of FIG. 4.
Figure 8:
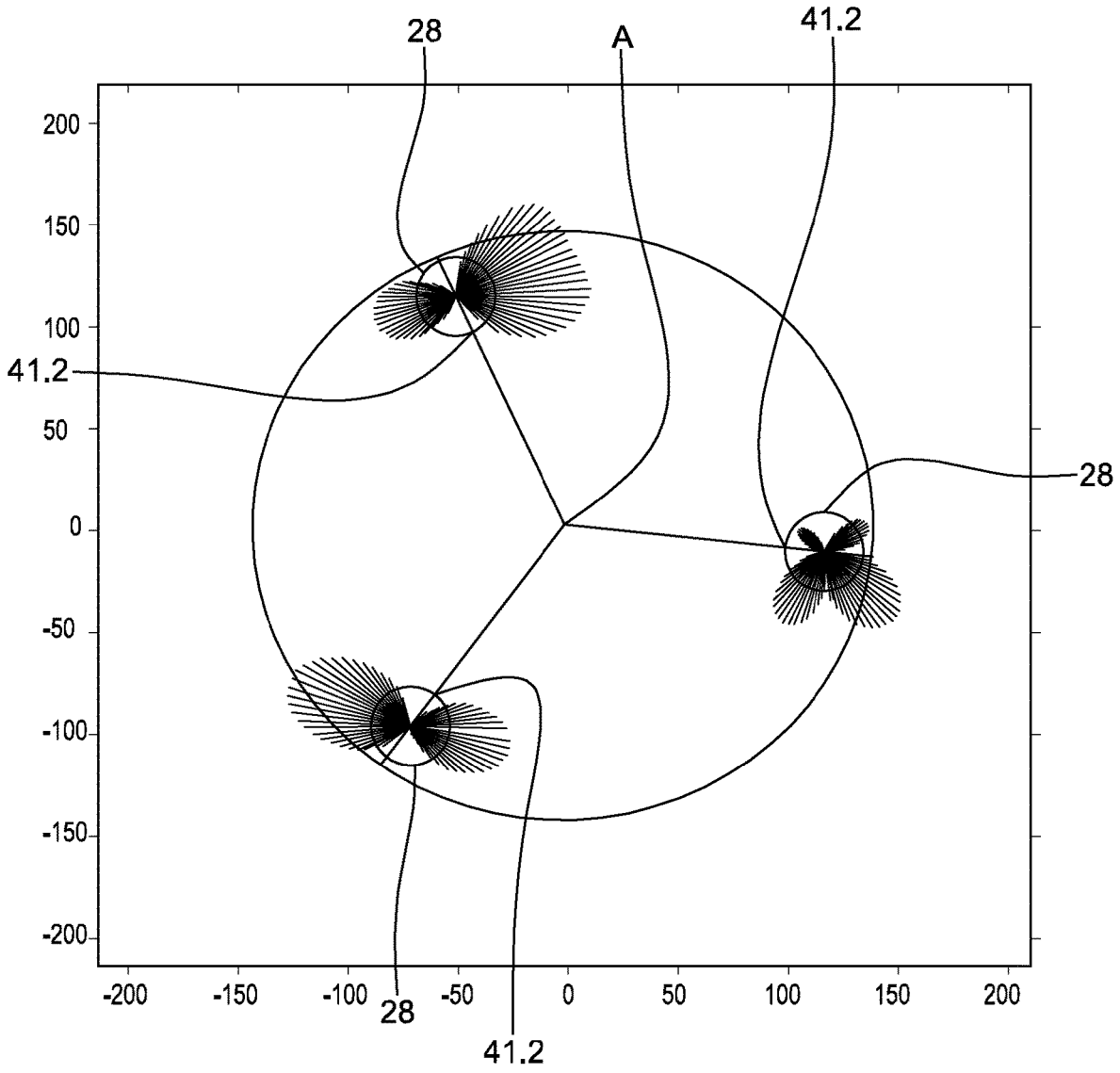
FIG. 8 is showing the repartition of the load (due to centrifugal forces and gas forces from the compression process) acting between outer circumferential bearing surfaces of orbital discs of the rotation preventing device and inner circumferential bearing surfaces of respective circular receiving holes during one revolution of a drive shaft the scroll compressor according to FIG. 1.

FIG. 7 particularly shows the fact that an orthogonal projection of the predetermined position of the oil outlet aperture 41.2 of each lubrication passage 41 on a projection plane parallel to the thrust bearing surface 9 could be located on a circular arc having an angle α between 0 and 20°, and for example between 0 and 10°, having a center C1 centered on the center C of the respective circular receiving hole 29, and being defined such that the respective plane P containing the rotation axis A of the drive shaft 16 and the center C of the respective circular receiving hole 29 forms a bisecting plane of the angle α of said circular arc, said circular arc being located between the rotation axis A of the drive shaft 16 and the center C of the respective circular receiving hole 29.

Of course, the invention is not restricted to the embodiment described above by way of non-limiting example, but on the contrary it encompasses all embodiments thereof. For example, the support arrangement may include a one-piece support frame including the thrust bearing surface 9.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed:

1. A scroll compressor including:

a fixed scroll comprising a fixed base plate and a fixed spiral wrap, an orbiting scroll including an orbiting base plate and an orbiting spiral wrap, the fixed spiral wrap and the orbiting spiral wrap forming a plurality of compression chambers, a drive shaft including a driving portion configured to drive the orbiting scroll in an orbital movement, the drive shaft being rotatable around a rotation axis (A), a support arrangement including a thrust bearing surface on which is slidably mounted the orbiting scroll, a rotation preventing device configured to prevent rotation of the orbiting scroll with respect to the fixed scroll and the support arrangement, the rotation preventing device including:

a plurality of orbital discs respectively arranged in circular receiving holes provided on the support arrangement, each orbital disc being provided with an eccentric hole and with an outer circumferential bearing surface configured to cooperate with an inner circumferential bearing surface provided on the respective circular receiving hole, and a plurality of pins each including a first end portion secured to the orbiting base plate and a second end portion rotatably mounted in the eccentric hole of a respective orbital disc, an oil sump, and a lubrication system configured to lubricate at least partially the inner and outer circumferential bearing surfaces with oil supplied from the oil sump, the lubrication system including a plurality of lubrication passages formed within the support arrangement, each lubrication passage including an oil outlet aperture emerging in the inner circumferential bearing surface) of a respective circular receiving hole and at a predetermined position where low load occurs during rotation of the drive shaft around its rotation axis.

2. The scroll compressor according to claim 1, wherein an orthogonal projection of the predetermined position of the oil outlet aperture of each lubrication passage on a projection plane parallel to the thrust bearing surface is located on a circular arc which has an angle (α) between 0 and 20°, which has a center (C1) centered on a center (C) of the respective circular receiving hole, and which is defined such that a respective plane containing the rotation axis (A) of the drive shaft and the center (C) of the respective circular receiving hole forms a bisecting plane of the angle of said circular arc.

3. The scroll compressor according to claim 2, wherein each lubrication passage extends radially with respect to the rotation axis (A) of the drive shaft.

4. The scroll compressor according to claim 2, wherein the lubrication system further includes a circumferential groove provided on an inner surface of the support arrangement, the circumferential groove being configured to supply the lubrication passages with oil.

5. The scroll compressor according to claim 1, wherein the predetermined position of the oil outlet aperture of each lubrication passage is substantially located in a respective plane containing the rotation axis (A) of the drive shaft and a center (C) of the respective circular receiving hole.

6. The scroll compressor according to claim 5, wherein each lubrication passage extends radially with respect to the rotation axis (A) of the drive shaft.

7. The scroll compressor according to claim 5, wherein the lubrication system further includes a circumferential groove provided on an inner surface of the support arrangement, the circumferential groove being configured to supply the lubrication passages with oil.

8. The scroll compressor according to claim 1, wherein each lubrication passage extends radially with respect to the rotation axis (A) of the drive shaft.

9. The scroll compressor according to claim 8, wherein the lubrication system further includes a circumferential groove provided on an inner surface of the support arrangement, the circumferential groove being configured to supply the lubrication passages with oil.

10. The scroll compressor according to claim 1, wherein the lubrication system further includes a circumferential groove (38) provided on an inner surface of the support arrangement, the circumferential groove being configured to supply the lubrication passages with oil.

11. The scroll compressor according to claim 10, wherein the counterweight comprises an oil supply passage with an inlet formed at the counterweight inner surface and an outlet facing the circumferential groove.

12. The scroll compressor according to claim 1, wherein the lubrication system further includes an oil supplying channel fluidly connected to the oil sump and extending over at least a part of the length of the drive shaft, the lubrication passages being fluidly connected to the oil supplying channel.

13. The scroll compressor according to claim 1, wherein the orbiting scroll further includes a hub portion in which the driving portion of the drive shaft is at least partially mounted, the scroll compressor further including a counterweight connected to the driving portion and configured to at least partially balance the mass of the orbiting scroll.

14. The scroll compressor according to claim 13, wherein the lubrication system further includes at least one oil supplying passage at least partially defined by the counterweight, the at least one oil supplying passage being configured to supply the thrust bearing surface and the lubrication passages with oil.

15. The scroll compressor according to claim 14, wherein the counterweight includes a counterweight inner surface and a counterweight end surface respectively facing the hub portion and the orbiting base plate, the counterweight inner surface and the counterweight end surface at least partially defining the at least one oil supplying passage.

16. The scroll compressor according to claim 14, wherein the lubrication system includes an oil feeding passage provided on the driving portion of the drive shaft and fluidly connected to the oil supplying channel, the oil feeding passage being configured to supply the at least one supplying passage with oil.

17. The scroll compressor according to claim 1, wherein the support arrangement includes a support frame and a thrust bearing plate secured to the support frame, the thrust bearing plate including the thrust bearing surface and the circular receiving holes, the lubrication passages being formed within the thrust bearing plate.

18. The scroll compressor according to claim 1, wherein the lubrication system further includes a plurality of oil return passages provided on the support arrangement, each oil return passage including an oil inlet port emerging in a respective one of the circular receiving holes and an oil outlet port fluidly connected to the oil sump and configured to return a part of the oil contained in the respective one of the circular receiving holes towards the oil sump.

19. The scroll compressor according to claim 18, wherein the oil return passages are formed in the support frame.

20. The scroll compressor according to claim 1, wherein the support arrangement further includes a main bearing configured to guide in rotation a guided portion of the drive shaft, the lubrication system being configured to lubricate at least partially the main bearing with oil supplied from the oil sump.

* * * * *